US007627410B2

(12) United States Patent
Berry et al.

(10) Patent No.: US 7,627,410 B2
(45) Date of Patent: Dec. 1, 2009

(54) MACHINE PAYLOAD MEASUREMENT DIAL-A-LOAD SYSTEM

(75) Inventors: Jeffrey K. Berry, Peoria, IL (US); Jeffrey D. Baskett, Peoria, IL (US); John J. Krone, Peoria, IL (US); Brian Mintah, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 564 days.

(21) Appl. No.: 11/299,403

(22) Filed: Dec. 12, 2005

(65) Prior Publication Data

US 2007/0135985 A1 Jun. 14, 2007

(51) Int. Cl.
*G06F 7/70* (2006.01)

(52) U.S. Cl. ..... 701/50; 701/1; 701/23; 701/25; 701/26; 701/27

(58) Field of Classification Search ..... 701/50, 701/1, 4; 414/332–347, 349–402, 467–559, 414/800–816; 37/396, 348, 414, 382; 177/136–139, 177/46, 47, 141; 702/173–175, 107; 172/7, 172/9, 4, 5

See application file for complete search history.

(56) References Cited

U.S. PATENT DOCUMENTS 4,377,043 A * 3/1983 Inui et al. ..... 37/414
4,627,013 A * 12/1986 Ichiyama et al. ..... 702/174
4,835,719 A 5/1989 Sorrells
4,921,578 A 5/1990 Shiraishi et al.
5,493,798 A * 2/1996 Rocke et al. ..... 37/348
5,682,312 A * 10/1997 Rocke ..... 701/50
5,754,965 A * 5/1998 Hagenbuch ..... 701/35
5,848,368 A 12/1998 Allen et al.
6,211,471 B1 * 4/2001 Rocke et al. ..... 177/136
6,858,809 B2 2/2005 Bender
2005/0000703 A1 * 1/2005 Furuno et al. ..... 172/2

* cited by examiner

*Primary Examiner*—Khoi Tran
*Assistant Examiner*—Bhavesh V Amin
(74) *Attorney, Agent, or Firm*—Liell & McNeil

(57) ABSTRACT

A method of loading a truck with material using a loader includes a step of determining a target load for a final pass. Material is loaded into a bucket of the loader in excess of the target load. Excess material is dumped from the bucket back to the pile in a controlled manner to arrive at a target load of reposed material in the bucket. The target load amount of the material in the bucket, which is less than a total amount of material originally loaded in the bucket is dumped into the truck by pitching the bucket. The bucket may be pitched to a determined pitch angle that is based upon the target load using an appropriate material curve stored on the loader. The pitch control algorithm can be calibrated by sensing the reposed weight of material in the bucket, and comparing that to an expected reposed weight, and then updating one of the material curves if there is a deviation.

5 Claims, 4 Drawing Sheets

MACHINE PAYLOAD MEASUREMENT DIAL-A-LOAD SYSTEM

TECHNICAL FIELD

The present disclosure relates generally to loading a container with a desired payload weight of loose material, and more particularly to dumping less than a total amount of material that was loaded into a bucket of a loader into a truck based on a dump control parameter.

BACKGROUND

In quarries and other types of payload material collection sites, mobile loaders, such as wheel loaders, backhoe loaders, and track type loaders are used to load loose payload material into haul vehicles, such as over the road trucks. Payload information, including the desired type and amount of payload material for each truck needs to be communicated to the quarry personnel who operate the loaders. For instance, this information might be transmitted from a quarry office based computer to a mobile computer on the loader via wireless communication as described in co-owned U.S. Pat. No. 5,848,368. This information enables the loader operator to proceed to the correct pile corresponding to the requested material.

A typical work cycle can begin with the operator first positioning the bucket of the loader at a pile of the requested material. The bucket is then lowered so that the work implement is near the ground surface. The operator then advances into the pile and controls the bucket to raise the work implement through the pile to fill the bucket and lift the material. The operator then tilts or pitches the bucket back to capture the material. The operator then moves the loader to a desired target location, such as an over the road truck, and dumps the captured material from the bucket. The operator then moves the loader back to the pile to start this work cycle over again. In the case of typical over the road trucks, depending upon their size, a full load will typically require between three and six bucket loads to fill the truck with the desired material up to a target load weight.

Many of today's loaders have payload control systems that allow for accurate measurements of the bucket payload. Thus, with each successive bucket, the loader can sum the load weight of the bucket loads to determine an estimated amount of payload already in the truck. Typically on a final pass of the truck loading cycle, the loader operator loads, weighs, and manually discards excess material to achieve the desired truck target payload weight. This process of manually discarding excess material is time consuming and wasteful since it requires trial and error weigh cycles. In the case of a typical over the road truck with a target load capacity of about 45 tons, it is difficult for even skilled operators to place an amount of material in the truck that is within 1,000 pounds of that target load, but without exceeding the target payload. Less skilled operators require substantially more time through trial and error to fully load a truck without exceeding the target weight, while still being acceptably close to the target payload weight.

After the truck has been loaded, to determine if the truck has been loaded with a desired amount of payload material, the truck is usually driven onto scales and weighed before leaving the quarry or other payload collection site. If the truck is overloaded, some of the payload material must be removed. Alternatively, if the truck is substantially underloaded, more payload material must be added. These processes cost additional time and money.

One strategy for dealing with these precision loading problems is described in co-owned U.S. Pat. No. 6,211,471. In that reference, the loader payload control logic determines that a final pass is needed to bring the truck payload up to a target payload weight. The control logic then controls the loader and implement actuators to retrieve and capture the desired weight of material into the bucket from the pile. The material is then dumped into the truck to bring it up to its desired target weight. Thus, this strategy seeks to retrieve a precise weight of material with the bucket from the pile using control logic, and then dump the entire contents of that partial bucket load into the truck. While this strategy appears to have promise, in practice there is great difficulty in precisely loading a desired weight of material in a bucket, as many variables contribute to, or detract from, the ability to accomplish this task on a reliable and repeatable basis.

The present disclosure is directed to overcoming one or more of the problems set forth above.

SUMMARY OF THE DISCLOSURE

In one aspect, a method of loading a truck with material includes a step of determining a dump control parameter based on a target load. Material is then loaded into the bucket of a loader in excess of the target load. An amount of material, which is less than the total amount of material loaded into the bucket, is then dumped by pitching the bucket according to the dump control parameter.

In another aspect, a loader includes a moveable bucket connected to a chassis. At least one sensor is also connected to the chassis. An electronic payload controller is supported on the chassis, is in communication with the at least one sensor, and is in control communication with a bucket tilt actuator. The payload controller includes a dump control algorithm operable to dump an amount, which is less than a total amount, of material from the bucket in a final pass. This is accomplished by pitching the bucket with the bucket tilt actuator according to a dump control parameter based on a target load.

DETAILED DESCRIPTION

Figure 1:
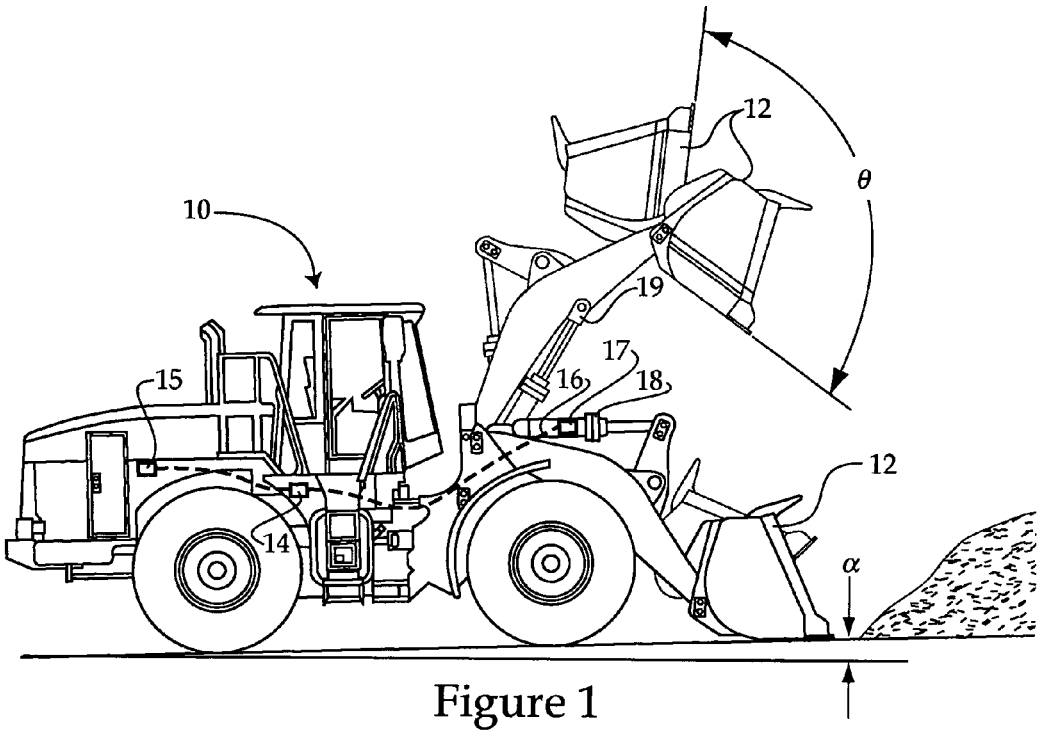
FIG. 1 is a side diagrammatic view of a loader according to one aspect of the present disclosure.

Referring to FIG. 1, a loader 10 includes a chassis 11 with a moveable bucket 12 connected thereto. Although loader 10 is illustrated as a wheel loader, those skilled in the art will appreciate that loader 10 could also be a backhoe loader, a track type loader, or any work machine that loads variable weights of relatively loose material, without departing from the intended scope of the present disclosure. Loader 10 includes an electronic payload controller 14, which may be any appropriate electronic control module or electronic controller with appropriate programming software or hardware known in the art. Electronic payload controller 14 receives information from at least one sensor, which can be any of a variety of sensors known in the art. In the illustrated disclosure, a displacement sensor 17 communicates a position of a bucket tilt actuator 18 to electronic payload controller 14 via a communication line 16. Although not shown, the electronic payload controller 14 receives commands from an operator in a conventional manner. These commands are then interpreted and transmitted to the appropriate actuators of loader 10 to accomplish some task. For instance, the raising of bucket 12 along with pitching of bucket 12 to the various positions and orientations shown in FIG. 1 is accomplished through appropriate control of hydraulic fluid to a hydraulic lift cylinder actuator 19 and a bucket tilt actuator 18 in a conventional manner. Those skilled in the art will appreciate that different loaders have different bucket capacities, and different available actuator ranges of motion. In the illustrated embodiment, the bucket tilt actuator can move bucket 12 through a pitch angle $\theta$, which is bounded by fully racked and fully dumped orientations, when the bucket is in the raised position. In addition to the displacement sensor 17, loader 10 may also include a chassis angle sensor 15 that communicates information to electronic payload controller 14 so that the angle $\alpha$ of the loader's deviation from horizontal can be determined. This aspect of the disclosure allows for the dump control algorithm of the electronic payload controller 14 to compensate for the deviation from horizontal angle $\alpha$ when performing the loading strategy described herein. Compensating for the deviation from horizontal can substantially increase accuracy of achieving a target load dump into a truck.

Figure 4:
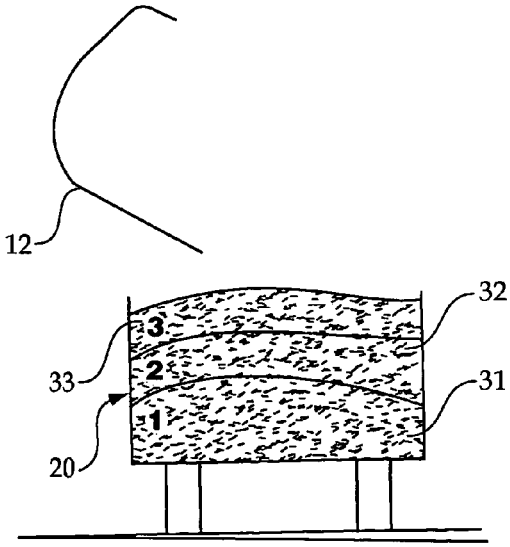
FIG. 4 is a schematic view of a truck after the reposed target load of FIG. 3 has been dumped into the truck.

The electronic payload controller 14 includes a dump control algorithm that is operable to dump an amount, which is less than a total amount, of material from the bucket in a final pass in an effort to achieve a target load in a truck. One example embodiment of the dump control algorithm 40 is shown in FIG. 4. However, those skilled in the art will appreciate that the dump control algorithm 40 illustrated in FIG. 4 represents only one of many different ways of organizing a dump control strategy according to the present disclosure, and many enhancements not shown in the FIG. 4 might also be included. In any event, any of the dump control algorithms according to the present disclosure will reflect the insight that when the bucket is loaded with a known material, and then pitched according to a pitch control parameter, such as to a known pitch angle $\theta$ or for a known duration, a relatively consistent amount of reposed material will remain in the bucket. This insight is utilized by the dump control algorithm to dump a precise weight of material from the bucket, which is less than a total amount of material in the bucket, to achieve a target load in a truck. Thus, the dump control algorithm will pitch the bucket 12 with a bucket tilt actuator 18 in a manner that is based upon the desired target load. The dump control algorithm may dump the excess material from the bucket back to the pile to arrive at a target load of reposed material in the bucket, which is subsequently dumped into the truck.

In one aspect, a plurality of stored material specific dump pitch angle data (tilt actuator displacement data) are available to the dump control algorithm in a conventional manner. This data may take any appropriate form, such as a look up table, a curve fit equation, or any other equivalent data format that correlates bucket pitch angle or bucket tilt actuator displacement distance and/or pressure to the weight of a reposed mass in the bucket for a variety of specific materials. Thus, in such an embodiment, the dump control algorithm would also include a selector algorithm operable to select one of the stored material specific pitch angle data for use in a particular final pass dumping procedure for that specific material.

In general, there is a goal of loading as much tonnage in a truck for the least amount of loader consumed fuel in the shortest amount of time, in order to achieve peak efficiency and low costs. However, due to the fact that over the road trucks may not be overloaded, there may be a constraint in that the truck payload has a tolerance of +0 pounds and −1000 pounds as being generally acceptable. Falling within a payload tolerance of +0 and −500 pounds is generally considered a desired load. However, it often takes some operators a considerable amount of time to achieve payload tolerances that are acceptable, let alone those that are desired. For example, for an over the road truck with a payload capacity of 45 tons, a first pass bucket load in the truck may contain about 18 tons and require about 30 seconds to complete. Likewise, a second pass may contain about 20 tons and require about 30 seconds to complete. Thus, the third pass requires about 7 tons, but may require as much as a minute and 40 seconds, or more, to accomplish depending upon the skill level of the loader operator. The present disclosure seeks to shrink that final pass duration in a way that saves fuel and time while also increasing accuracy by exploiting the dump control algorithm according to the present disclosure.

Figure 2:
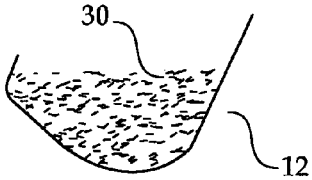
FIG. 2 is a schematic view of a loader bucket with a final pass load before dumping any material into a truck or back to the pile.
Figure 3:
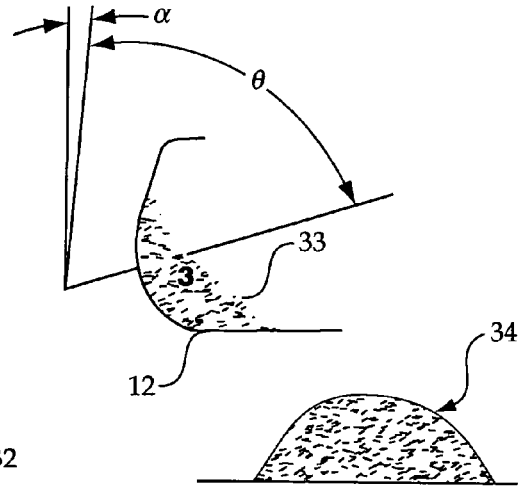
FIG. 3 is a schematic view after an excess load amount has been dumped from the bucket of FIG. 2 to arrive at a target load reposed in the bucket.
Figure 5:
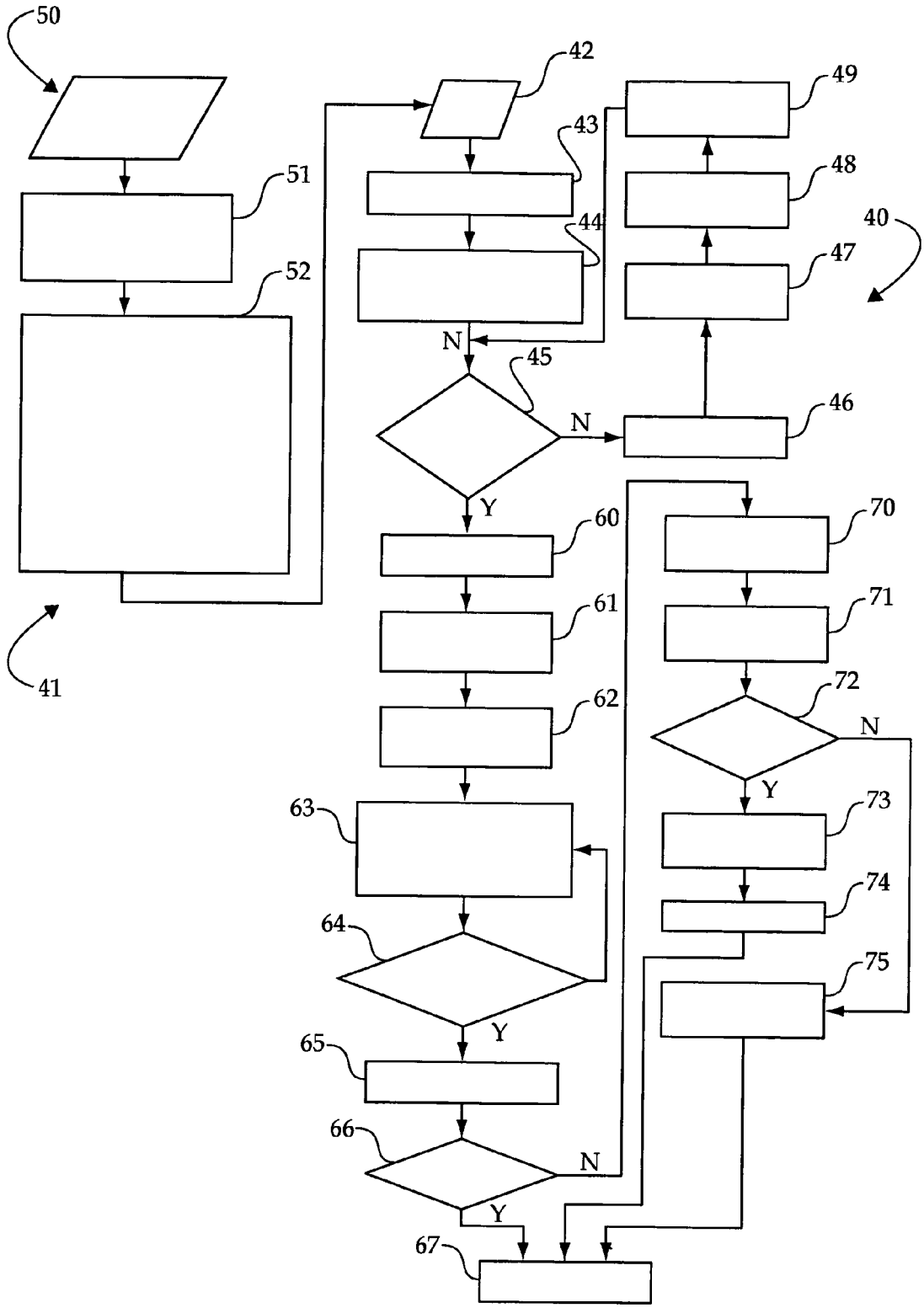
FIG. 5 is a software flow diagram of a dump control algorithm according to the present disclosure.

Referring now in addition to FIGS. 2-4, an example final pass dumping procedure as illustrated in the context of the dump control algorithm 40 illustrated in FIG. 5. At boxes 41, the dump control algorithm may be calibrated, such as when the loader is brought into service on a particular day. The calibration procedure 41 may begin by initializing the machine to warm the hydraulic fluid up to temperature, insure that pins are greased, and maybe attempting to move the loader 10 onto level terrain, and then fill the bucket with a calibration load. In box 51, sensor and actuator check outs may be performed by insuring a minimum cylinder head and pressure requirement and to check to insure that the bucket 12 may be moved to a full rack position. Bucket payload controller 14 may also sense a minimum required weight in the bucket. All of these sensor and actuator check outs, and possibly others, are performed to prevent possible false calibration triggers.

In step 52, other initial calibration steps may be performed. These may include filling the bucket with material, and actuating the lift linkage to a required calibration linkage height. A dump command is then determined and sent for a predetermined maximum reposed load weight in the bucket. The dump tilt actuator 18 is then dumped according to a predetermined angle and possibly held for about 15 seconds or any required time that may be necessary for a calibration step for the material to settle. The pitch tilt angle actually achieved may then be logged and compared to the commanded pitch angle bucket stops at a desired pitch angle during regular operation. It may then be fully racked and raised through the weighing cycle and the reposed weight in the bucket may be stored and compared to an expected reposed maximum weight. This calibration procedure may then proceed to four or more other tilt displacement angles that may be evenly spaced on a tilt displacement curves. (See FIGS. 6 and 7). The electronic payload controller 14 may then perform a quadratic regression and assign material type in ambient conditions to the data points retrieved during the calibration procedure. This determined calibration curve may then be compared to a material default curve stored in memory. If a difference is within acceptable offset limits, then the default curve stored may be used. Alternatively, the obtained regression curve may be used if no default curve exists in memory. Later in the day as loading continues, this stored regression curve may be continually populated and updated with measured data to refine the curve for further accuracy. Thus, those skilled in the art will appreciate that families of curves for different materials of interest may be built and/or stored in this manner.

After the calibration steps the operation may then continue on to step 42 for regular operation. In general, the algorithm will proceed by loading full bucket loads of material into truck 20, such as loads 1 and 2 of FIG. 4 that reflect full bucket loads 31 and 32 dumped into truck 20. These initial loads are carried out according to steps 45-49. In particular, at step 45 there is a determination of whether a final pass situation has arisen by determining if the requested payload is greater than the average bucket payloads for this particular material. If no, the operator or the payload controller will weight the load at step 46 and that measure of weight is added to the accumulated weight total calculation at step 47. At step 48, the load, which may be the first load 31 or the second load 32 is dumped into the truck, and the loader 10 returns to the pile. At step 49, the payload controller 14 will subtract the delivered payload from the request payload for truck 40. The software flow diagram may then return to determination step 45 in order to determine that a final pass situation has arrived. During these initial bucket loads, the loader 10 will sense the weight of each bucket load, and calculate an accumulated total of payload weight by summing the individual bucket loads and storing that information for use during the loading procedure. This accumulated payload weight can be compared after each bucket load dumping procedure to a target payload for a total target payload weight for truck 20. When the difference between the weight of material already loaded in the truck and the total target payload weight drops below the weight capacity of the bucket 12 for that specific material 30, the payload weight controller 14 will determine that it is in a final pass mode and thus will initiate the dump control algorithm. Preferably, the weight capacity of the bucket should be substantially more than the final pass target load in order to increase the accuracy of the dump control algorithm. For instance, it may be desirable to load at least 25% more weight of material in the bucket than is required to achieve the target load.

In one aspect, the operator may simply fill the bucket in the final pass just as he or she had done for the previous bucket passes. If the algorithm determines that the final pass situation exists, the algorithm may advance to box 60 where the operator may be alerted to the final pass situation, such as via an audible cue. Next, at box 61, the dump control algorithm may be initiated by the payload controller 14 itself or possibly by some action on the part of the operator, such as by pushing a button. Assuming that the loader is working in an environment with a variety of different materials, and recognizing the insight of the present disclosure that different materials behave differently when being dumped from the bucket, a selector algorithm will choose data at step 62 associated with the specific material being loaded. In other words, the present disclosure recognizes that at a given pitch angle, a different weight of reposed material will remain in the bucket depending upon what the specific material is. In step 62, the dump control algorithm also selects a desired bucket pitch angle from the material specific data, which may be interpolated from a table or calculated from a material specific function curve, or in any other appropriate manner known in the art. This angle may be reflected by a dump control parameter, such as tilt cylinder displacement or tilt cylinder actuation duration. It may be important to note that while gathering data for a wide variety of fine and course aggregates, it was recognized that material specific curves can be very accurately represented by a second order polynomial across a wide range of different materials. Nevertheless, those skilled in the art will appreciate that the present disclosure contemplates other curve fits, such as less accurate linear curve estimates and more sophisticated higher order polynomial curve fits, without departing from the intended scope of the present disclosure.

The loader may still be at the pile, and the bucket 12 may be raised to a middle position. In step 63, the electronic payload controller commands the bucket pitch actuator 18 to displace a distance or to a pressure corresponding to the desired pitch angle, and then stop. This action dumps the excess material back to the pile and retains a reposed amount corresponding to the target load in the bucket. This procedure may be monitored in step 47 by continuously determining what the bucket pitch angle is according to information provided by tilt actuator displacement sensor 17 to determine when the bucket is at or near the desired pitch angle. If not, the control algorithm may return to step 63 and continue the bucket pitching. If the desired pitch angle has been achieved or nearly achieved, a stop pulse may be generated to stop the bucket pitching procedure to stop at the desired pitch angle at box 65, which may be maintained for some duration, such as several seconds, to allow the material to come to rest. At this point, a desired weight of reposed material 33 should remain in bucket 12 as shown in FIG. 3. The loader then fully racks bucket 12 and raises it to its upper position and moves to truck 20. As shown in FIG. 4, the loader then displaces bucket 12 from its fully racked position to dump the reposed material 33 into truck 20 as a third load 3 as shown in FIG. 4. This dumping step is reflected at box 67 in control algorithm 40. Before this is performed, the algorithm may include a determination of whether the control algorithm should be updated or recalibrated at step 66. A precise amount of material 33 in the third and final pass should be in truck 20 to arrive at the total truck payload target weight.

In another aspect of the present disclosure there is a recognition that the loading operation may not be occurring on a horizontal plane. In other words, the loader may be operating on a plane at some angle $\alpha$ deviating from the horizontal. The deviation from horizontal angle $\alpha$ can be determined in a conventional manner, such as using a chassis angle sensor 15 mounted in an appropriate location on chassis 11 of loader 10. This information may also be supplied to the electronic payload controller 14 in another manner known in the art, such as via an operator input or a wireless transmission. In any event, those skilled in the art will recognize that more accurate results can be obtained if the deviation from horizontal angle $\alpha$ is taken into account when the desired bucket pitch angle $\theta$ is executed for dumping the desired portion of the bucket weight into the truck 20. For instance, if the loading operation is occurring on an uphill slope as shown in FIGS. 1-3, one may calculate a desired pitch angle $\theta$ as if the operation was being performed on a level surface, and then add to that desired pitch angle $\theta$ the deviation from horizontal angle $\alpha$ as shown in FIG. 3 to arrive at an apparently appropriate bucket pitch angle $(\theta+\alpha)$ that is the sum of the horizontally derived pitch angle $\theta$ plus the deviation from horizontal angle $\alpha$. On the other hand, if the operation was taking place on a downward slope, one would subtract the deviation angle $\alpha$ from the desired pitch angle to arrive at an adjusted pitch angle for that final pass dumping operation. Although not illustrated, those skilled in the art will appreciate that a deviation from horizontal in a roll axis could also be accounted for according to the present disclosure, such as by including a correction factor for a roll angle, or including stored surface curves that include roll angle as an additional axis or look up table variable.

Although the present disclosure has been described in the context of the loader carrying with it a plurality of material specific pitch angle data curves, other alternatives are contemplated. For instance, the loader may not have any stored data, and instead construct curves in nearly real time performing maybe as few as five dump cycles for a variety of different pitch angles, as described in relation to the calibration procedure 41, while measuring and recording the reposed weights left in the bucket for each one of those data points. Next, using the insight that a second order polynomial works very well in approximating the relationship between reposed weight in the bucket to tilt actuator displacement distance, a curve fitting algorithm could be applied to the data points to generate a material specific curve for that day's work cycle. This aspect of the invention recognizes that old experimental data can become stale, in that it may not fully reflect the subtle changes that can occur between different materials that are characterized as being the same thing. For instance, concrete sand at a test facility at one time could generate a certain data curve, but the supposedly same material may behave differently at a different time and place. For instance, moisture in the material, and other known factors, such as varieties in particle size, can alter its dumping characteristics.

In still another alternative embodiment, pre-stored data curves can be supplemented and calibrated in real time. This aspect of the disclosure may be initiated at step 66. For instance, at the beginning of a day, an operator may begin using stored data curves, which may have been generated by the loader itself yesterday, or originate from the factory, or be generated during calibration 41, or possibly a combination of all three. But with each final pass dumping operation, a data point could be recorded so that the stored curve could be calibrated accordingly. In particular, the reposed weight in the bucket during the final pass dumping procedure would be raised, and its weight sensed after the excess had been returned to the pile. This weighing procedure is performed at step 70 in a known manner. The sensed weight would then be compared to an expected reposed weight to generate an error of measurement at box 71 that could be used to calibrate the stored material data curve accordingly at box 73. At determination step 72, the curves may not need updating unless the error exceeds some predetermined threshold. If the stored data curves are in need of being updated by the error being too large, the control algorithm may also command an increase in the data sampling rate at 74 to hasten the updating of the material data curves. In an enhanced version of this embodiment, data taken would be weighted according to how recent that data point was obtained. In other words, more recent data points might be weighted more heavily than older obtained data points in applying a calibration modification to a stored material data curve. If the determination step 72 determines that the error is relatively low, the controller may command a decrease in the sampling update rate at step 75.

In another aspect of the present disclosure, the bucket pitching procedure may be performed either open loop or in a closed loop fashion. In an open loop fashion, the bucket tilt actuator 18 is commanded to a certain displacement which may be done open loop by determining a displacement duration multiplied by a known displacement rate for the bucket actuator. In a closed loop alternative, the bucket displacement distance would be monitored during the bucket pitching procedure, as the bucket 12 approached the desired pitch angle, the pitching actuator 18 would be slowed and eventually stopped to arrive precisely at the desired pitch angle. Either alternative falls within the contemplated scope of the present disclosure.

In one potential enhancement to the dumping strategy previously described, the bucket may be dithered, especially as it approached, or after it arrived at, the desired dump pitch angle. This dithering could be accomplished with known techniques that send appropriate control signals to the bucket pitch actuator 18 to cause a superimposed dithering motion on the pitching motion so that the material in the bucket behaves more fluid like, and hence more predictable, during the final pass dumping procedure. Alternatively, the bucket could pitch and stop at the desired pitch angle in possibly an open loop fashion, and then either a manual or automatically controlled dithering operation could be performed to increase the accuracy of the final pass dumping procedure. Those skilled in the art will appreciate that other enhancements could be brought to bear on the present disclosure without departing from its intended scope. For instance, the changes in the quantities dumped due to how abruptly the bucket is stopped at its desired pitch angle could be accounted for, and possibly exploited.

INDUSTRIAL APPLICABILITY

The present disclosure finds potential application in any case where a loading machine, such as a loader, is being used to dump a precise weight of material at a specific location, such as into a truck, rail car or the like. Thus, as used in the present disclosure, the term truck is intended to mean any transportable man made container that can hold material dumped from a loader bucket either directly or indirectly. For instance, the loader may dump the material on a conveyer belt which then delivers the material to a truck, and such an alternative would not be a departure from the present disclosure. Thus, although the present disclosure is described in the context of loading aggregate materials into over the road trucks, it need not be so limited, and there are numerous other applications where precise weights of dumped material are necessary, including but not limited to agricultural applications and many others known in the art.

Because of the different shapes, sizes and capabilities of each loader, it may be necessary to prepare material specific data curves that are specific to each loader and/or bucket. On the other hand, a curve fitting algorithm could be used that would be applicable to virtually any loader that could curve fit data obtained by that loader in the field without reliance upon any experimental data.

Figure 6:
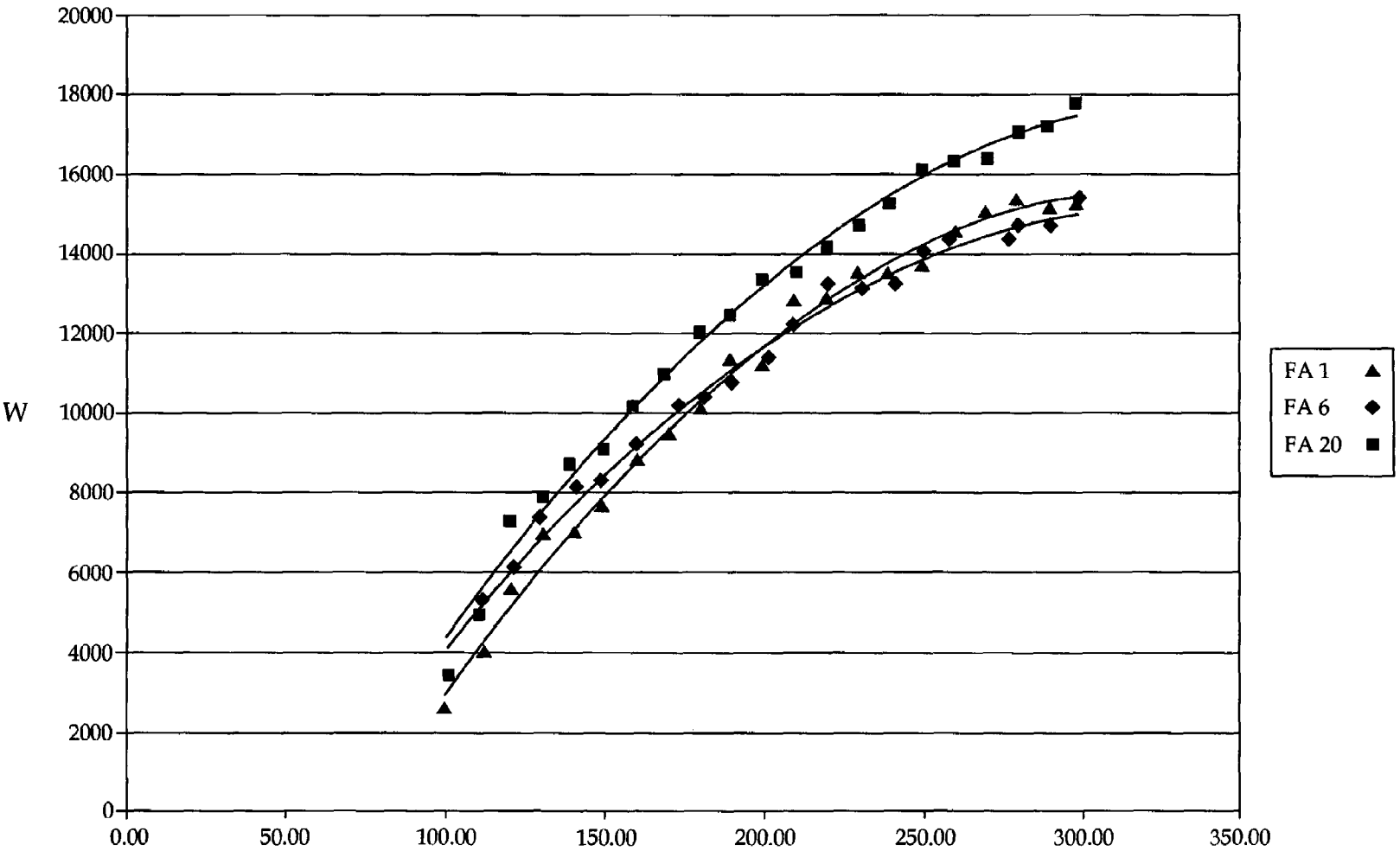
FIG. 6 is a graph of reposed weight verses bucket tilt cylinder displacement for several fine aggregates according to the present disclosure.
Figure 7:
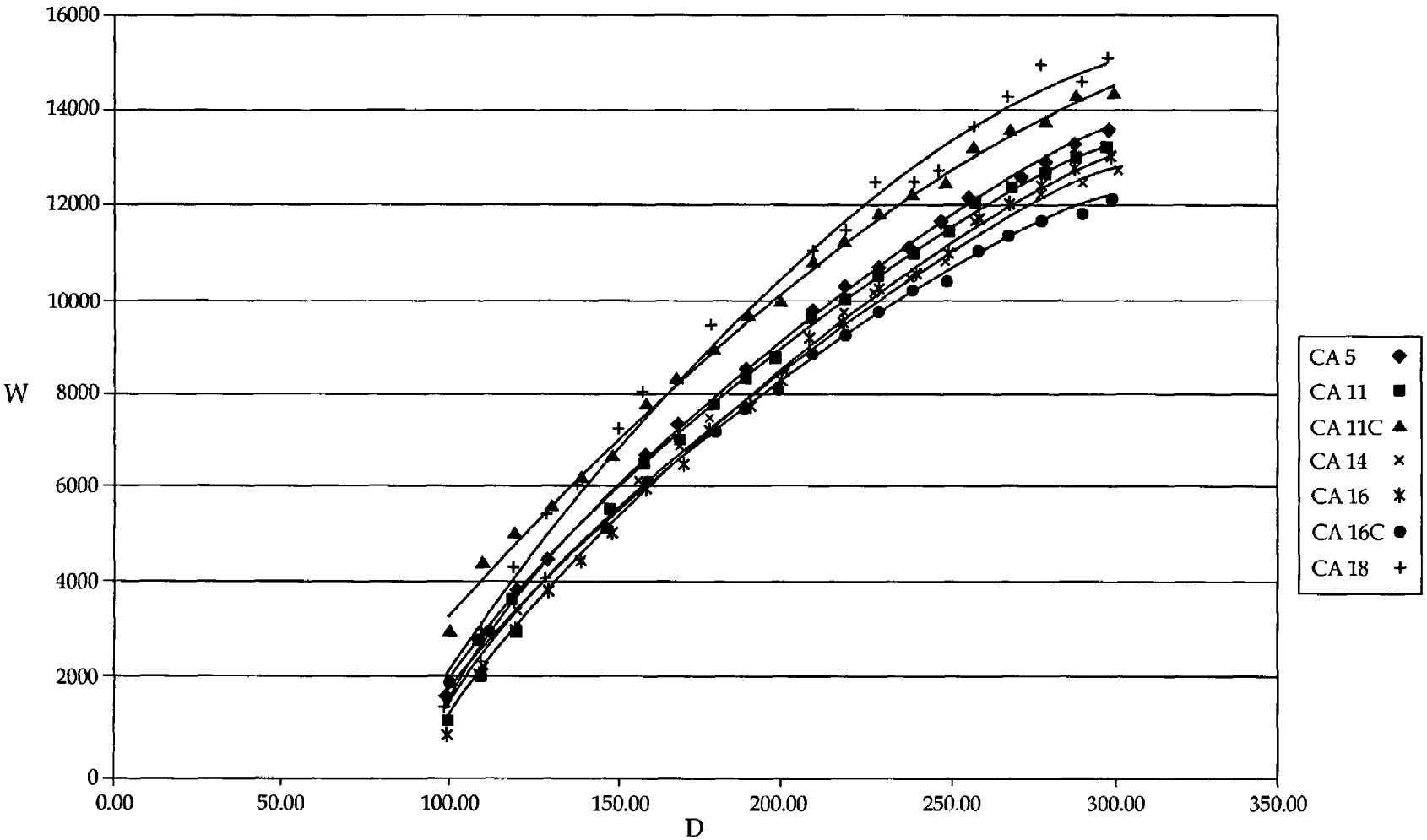
FIG. 7 is a graph of reposed weight verses bucket tilt cylinder displacement for seven different course aggregates according to the present disclosure.

The table below lists several fine aggregates and course aggregates with a brief description of their normal usages that were tested for the present disclosure. The D axis represents millimeters of bucket tilt actuator displacement, and the W axis represents reposed weight of material remaining in the bucket. FIGS. 6 and 7 show the raw data along with a second order polynomial curve fit for each of the materials.

| Designation | Description | Usage |
|---|---|---|
| FA 1 | Concrete Sand | Used in Concrete mixes |
| FA 6 | Fill sand | Backfill trenches |
| FA 20 | Manufactured Sand | Used in Asphalt |
| CA 5 | 1½" Rock | Sewer Filter beds |
| CA 6 | 1¼" Road Gravel | Base material for roads and parking lots |
| CA 7 | 1" Rock | Concrete mixes |
| CA 10 | 1" Road Gravel | Base material for roads and |

-continued

| Designation | Description | Usage |
|---|---|---|
| | | parking lots (Freeways typically) |
| CA 11 | ¾" Rock | Concrete (typically for hand finished surfaces - sidewalks, pavements, etc.) |
| CA 11 Crushed | ¾" Rock-crushed | Freeze-thaw approved for sanitary sewer beds |
| CA 14 | ⅝" Rock | Concrete backfilling |
| CA 14 Crushed | ⅝" Rock-crushed | Freeze-thaw approved backfill for house foundations |
| CA 16 | ⅜" Pea Gravel | Seal coating for tar roads |
| CA 16 Crushed | ⅜" Pea Gravel-crushed | Freeze-thaw approved backfill for house foundations |
| CA 18 | Fill sand | Backfill for water lines |

Those skilled in the art will appreciate that the present disclosure can be implemented in a number of ways. For instance, the control logic governing the pitching procedure can be developed using cylinder actuator pressures as an input to the electronic payload controller 14. Cylinder pressures may then be continuously monitored and used as both input and output by the controller. The cylinder pressures may be used to control bucket pitch angle θ. When operating in a closed loop fashion, the bucket pitch may be dynamically controlled via a closed loop using the pressure based control law. When the desired displacement is reached, the bucket is stopped and the desired amount of material has been dumped into the truck or back to pile. When operating in an open loop fashion, a displacement duration can be utilized to pitch the bucket through a known pitch angle that corresponds to the actuator displacement duration, and stopping at the bucket at the desired pitch angle after the duration is completed.

The present disclosure provides a methodology to improve payload measurement accuracy and repeatability which results in a more efficient operation through both fuel and time savings, as well as the efficiency increased by more accurate overall truck loadings. Thus, this improved efficiency could allow for an increase in throughput of trucks from a load out area, such as a quarry. In other words, a measurable number of additional complete truck loads may be able to be retrieved from a quarry in a given work period, when the present disclosure is implemented. The present disclosure should also reduce time wasted by having to add material or remove material from trucks that have been incorrectly loaded. In addition, the present disclosure can reduce the impact brought to loading operations by inexperienced operators by allowing them to improve there speed and accuracy on par with more experienced operators. The present disclosure also provides for the possibility of reducing operator fatigue, especially that associated with the trial and error repeated attempts to bring a desired load into a bucket in a final pass cycle according to the prior art.

It should be understood that the above description is intended for illustrative purposes only, and is not intended to limit the scope of the present disclosure in any way. For instance, although the present disclosure has been described in the context of controllably dumping a portion of a bucket load back to pile to achieve a desired target load reposed weight in the bucket, an alternative exists that falls within the contemplated disclosure. In particular, the payload controller may be utilized to dump controlled amount of material from the bucket into the truck and return the reposed material back to the pile so that the reposed weight in the bucket represents precisely the excess amount from the initial bucket final pass load that was necessary to achieve the total target load in the truck. Thus, the disclosure contemplates the reposed weight in the bucket after the controlled dumping procedure representing either the target load or the weight that is in excess of the target load. Although the present disclosure has been described in the context of the dumping procedure being controlled by the payload controller 14, the disclosure also contemplates substantially more amount of operator control over the procedure. For instance, the operator may be continuously provided with bucket pitch angle information and the desired pitch angle, and may manually move the bucket to the desired pitch angle without departing from the intended scope of the present disclosure. Thus, those skilled in the art will appreciate that other aspects, objects, and advantages of the disclosure can be obtained from a study of the drawings, the disclosure and the appended claims.

What is claimed is:

1. A method of loading a truck with material, comprising the steps of:

loading material into a bucket in excess of a target load;

determining a dump control parameter based on the target load;

dumping an amount, which is less than a total amount loaded into the bucket, of the material by pitching the bucket according to the dump control parameter;

determining the target load as a difference between a desired truck load weight and a current truck load weight;

the dump control determination step includes a step of determining a value indicative of a desired pitch angle based on the target load;

the pitching step includes pitching the bucket to stop at the desired pitch angle;

monitoring a value indicative of a pitch angle error during at least a portion of the pitching step; and ending the pitching step as the pitching angle error approaches zero.

2. A method of loading a truck with material, comprising the steps of:

loading material into a bucket in excess of a target load;

determining a dump control parameter based on the target load;

dumping an amount, which is less than a total amount loaded into bucket, of the material by pitching the bucket according to the dump control parameter;

wherein the determining step includes a step of determining a desired pitching duration based on the target load; and the pitching step includes pitching the bucket for the desired pitching duration.

3. A method of loading a truck with material, comprising the steps of:

loading material into a bucket in excess of a target load;

determining a dump control parameter based on the target load;

dumping an amount, which is less than a total amount loaded into the bucket, of the material by pitching the bucket according to the dump control parameter;

determining a deviation from horizontal of a loader that includes the bucket;

identifying the material in the bucket; and the pitching step is also based on an identity of the material in the bucket and a determined deviation from the horizontal of the loader;

sensing a reposed weight of material in the bucket following the dumping step;

comparing the sensed reposed weight to an expected reposed weight;

the dumping step is performed according to stored dump data; and calibrating the dump data for use in a subsequent dumping step based on a difference between the sensed weight and the expected reposed weight.

4. The method of claim 3 including a step of determining a value indicative of a desired pitch angle based on the target load; and the pitching step includes pitching the bucket to stop at the desired pitch angle.

5. The method of claim 3 including a step of determining a desired pitching duration based on the target load and the sensed weight; and the pitching step includes pitching the bucket for the desired pitching duration.

* * * * *